United States Patent [19]

Swanson, Jr.

[11] 4,019,438

[45] Apr. 26, 1977

[54] SLEEVING AND SLEEVING STAND APPARATUS AND METHOD

[75] Inventor: Floyd R. Swanson, Jr., Cedar Falls, Iowa

[73] Assignee: Swanson Engineering, Inc., Cedar Falls, Iowa

[22] Filed: June 16, 1975

[21] Appl. No.: 586,957

[52] U.S. Cl. ..... 102/24 R; 156/268

[51] Int. Cl.[2] ..... F42B 3/00

[58] Field of Search ..... 102/24; 86/20 C; 93/DIG. 1; 156/250, 268

[56] References Cited

UNITED STATES PATENTS

| | | | |
|---|---|---|---|
| 3,321,354 | 5/1967 | Sloan et al. | 93/DIG. 1 |
| 3,760,727 | 9/1973 | Callister et al. | 102/24 R |

FOREIGN PATENTS OR APPLICATIONS

| | | | |
|---|---|---|---|
| 667,051 | 7/1963 | Canada | 102/24 R |

*Primary Examiner*—Verlin R. Pendegrass
*Attorney, Agent, or Firm*—Zarley, McKee, Thomte & Voorhees

[57] ABSTRACT

This application relates to a sleeving stand, a sleeving and a method of using a sleeving for loading blast holes with explosive, after those holes are lined with a blast hole liner in order to prevent water from interfering with the effective use of the explosive. The blast hole liner is of a convenient construction for easy use to line a blast hole and involves forward and rear panels and oppositely disposed gusset walls. The sleeving stand is a stand for use of the blast hole liner and for convenient dispensing of the blast hole liner in a blast hole.

2 Claims, 8 Drawing Figures

SLEEVING AND SLEEVING STAND APPARATUS AND METHOD

BACKGROUND OF THE INVENTION

In the mining industry, in fields such as rock quarry excavation and the like, the desired mineral often lies below ground level. Explosive charges are employed to break up the mineral into small pieces so that it may easily be gathered. In this process, typically a plurality of blast holes arranging in diameter from a few inches to well over a foot are drilled in the earth and explosive charges are inserted in the blast hole, together with primers to detonate the charges.

The most commonly used explosive for such blast holes is ammonium nitrate which typically contains a small amount of fuel oil, i.e., about 6%. In the industry this explosive which is in the form of a loose powder bulk material is referred to as "ANFO." When ANFO is wetted over 11%, it will not explode; at water levels less than 11%, the explosive quality of the material and the force of the explosive blast is not nearly as satisfactory as when the blast hole is dry.

Of course, in areas which have high ground water content, it often happens that a blast hole after drilling will fill with water. Of course, if the blast hole is filled with water, this will result in a wetting of the ANFO charge coupled with an attendant decrease or lessening in the effectiveness of the blast. As a result a first step involves dewatering the blast hole, and this is done prior to lining of the blast hole as explained hereinafter.

Efforts to solve this problem in the prior art have resulted in the utilization of blast hole liners. This invention relates to an improved blast hole liner and to an apparatus for conveniently dispensing the improved blast hole liner.

As one can well imagine, it is often very difficult to quickly and efficiently place a moisture-proof blast hole liner in a blast hole of reasonably small diameter. Many potential interfering possibilities can occur which may necessitate long waiting times between actual drilling of a blast hole and use of the blast hole. Of course, such long time lapses are uneconomical, inefficient and wasteful. As an example, flat blast hole liner sleeves of the construction shown in Kallister et al, U.S. Pat. No. 3,706,727 are often unsatisfactory and nonusable because flat blast hole liners have a propensity to develop air pockets therein during the pouring of ANFO in the blast hole liner with the result being that an ANFO does not easily fall to the bottom of the liner. Such air pockets once formed eventually will dissipate because of the bulk form of the ANFO but this often will take 15 to 30 minutes which represents an intolerable delay. In addition, blast hole liners having flat edges forming a longitudinal sleeve seam are unsuitable since the flat sleeve edges often press against the blast hole walls which may be wet, and may adhere to the blast hole walls and prevent the effective lowering of the liner to the bottom of the blast hole. In addition, where the blast hole walls are somewhat uneven, blast hole liners of the flat design having longitudinal seams often rub against the blast hole wall and can snag on ragged edges of the wall causing leakage in the liner.

In addition to a preferred structure for a blast hole liner, applicant's invention also involves the development of a convenient dispensing stand for a blast hole liner. This stand is portable, light weight and convenient for usage under a variety of circumstances and conditions. In addition, this stand allows for a significant decrease in time for placing a blast hole liner in a blast hole and filling the liner with an explosive charge of ANFO or the like.

Accordingly, one object of this invention is to provide an improved blast hole liner.

Another object of this invention is to provide an improved blast hole liner which if free from longitudinal seams and/or edges extending along the sleeve.

Yet another object of this invention is to provide a blast hole liner which can quickly and easily be manufactured from a roll of liner sleeving.

Yet another object of this invention is to provide a blast hole liner which is of a construction which prevents air pockets from forming during the loading of bulk explosive into the blast hole liner.

Yet another object of this invention is to provide a blast hole liner which is of a construction which will prevent the blast hole liner from adhering to the wet walls of a blast hole and which will minimize the possibility of the blast hole liner from snagging on the ragged edges of the blast hole walls.

Yet another object of this invention is to provide a portable blast hole liner sleeving stand.

Yet another object of this invention is to provide a blast hole sleeving stand which is light weight, easy to use, and which will significantly decrease the amount of time required to be expended during the lining of a blast hole.

Still a further object of this invention is to provide a blast hole liner sleeving stand which will releasably secure a blast hole liner and which will allow for convenient filling of a blast hole liner with bulk blasting powder.

The method of accomplishing these and other objects will readily become apparent from the following detailed description of the invention.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings in which:

DETAILED DESCRIPTION OF THE INVENTION

Figure 1:
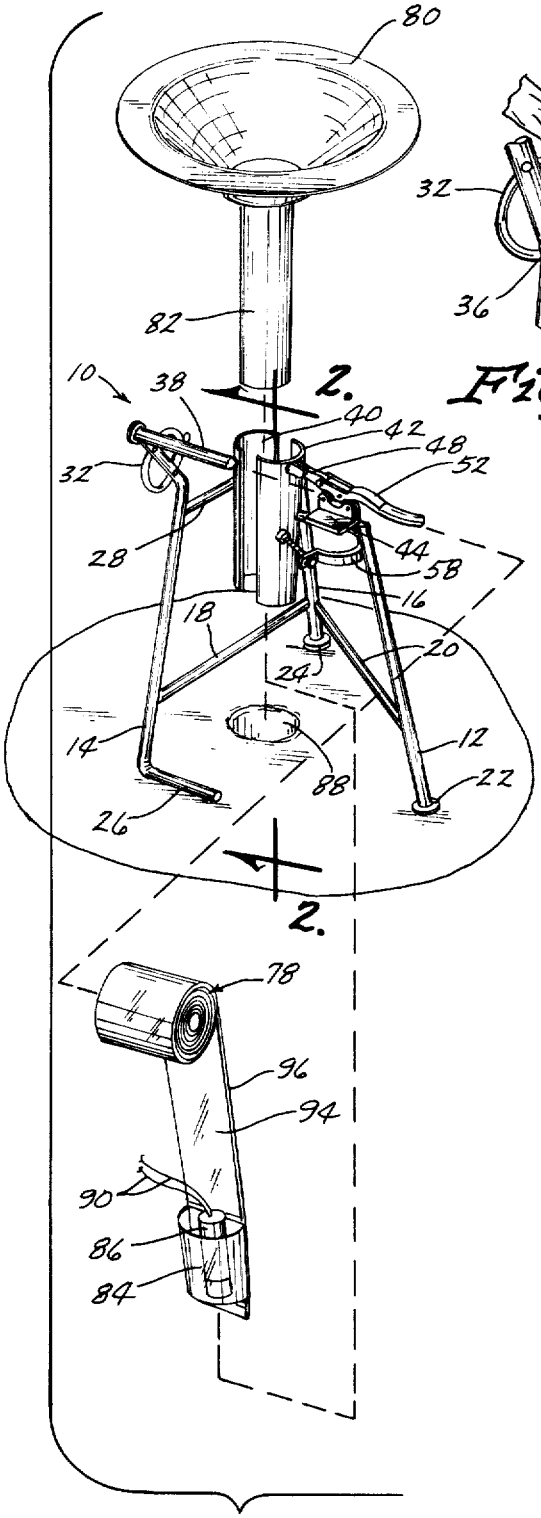
FIG. 1 is an exploded perspective view showing the blast hole liner stand, and all of its component parts including the blast hole liner.

The blast hole sleeving stand 10 has a frame comprised of legs 12, 14 and 16 which extend upwardly and inwardly. Brace 18 extends between legs 14 and 16 and brace 20 extends between legs 12 and 16.

Legs 12 and 16 have mounted on the bottom thereof for engagement with the ground pads 22 and 24.

Leg 14, at its bottom, does not terminate in a ground engaging pad as do legs 12 and 16 but rather leg 14 is bent at ground level to provide a foot stand 26 which engages the ground. Foot stand 26 can be conveniently used by the user of the blast hole sleeving stand for placement of his foot thereon in order to secure the stand in its ground engaging position to prevent disalignment of the stand with the bore hole during use.

At the top of the stand, brace 28 extends between leg 14 and leg 16 and brace 30 extends in like manner between leg 16 and leg 12.

Figure 3:
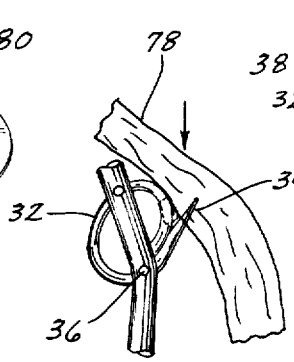
FIG. 3 is an exploded view showing the liner cutter of the stand and its manner of use for cutting the blast hole liner.
Figure 2:
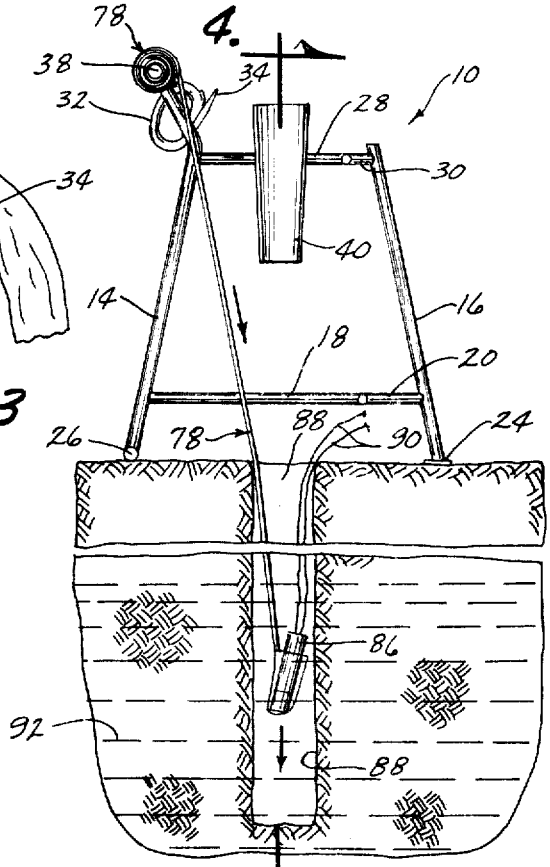
FIG. 2 is a view of the blast hole liner stand of FIG. 1 along line 2—2 of FIG. 1 showing the blast hole liner in position on the stand and feeding from the stand into a blast hole.

Leg 14, above brace 26, extends upwardly and rearwardly in the manner shown in FIG. 1 and has mounted thereon cutter 32 having a projecting cutting edge 34. Cutter 32 is mounted to leg 14 by conventional nut and bolt assembly as shown in FIG. 3 at 36. At the top edge of leg 14, extending outwardly therefrom in parallel relationship to the ground, is spindle 38. Spindle 38 as will be apparent from the description which follows, is for placing a roll of blast hole liner thereon.

A sleeving stand throat expander is mounted on the frame as described above. The throat expander is comprised of two oppositely disposed arcuate sleeves of generally semicircular cross section. A first arcuate sleeve is mounted by welding or conventional means on brace 28 and is a non-movable arcuate sleeve 40. A second arcuate sleeve of like configuration is oppositely disposed from non-movable sleeve 40 but is a movable sleeve 42. Non-movable sleeve 40 and movable sleeve 42 form the throat expander of the blast hole sleeving stand.

Figure 5:
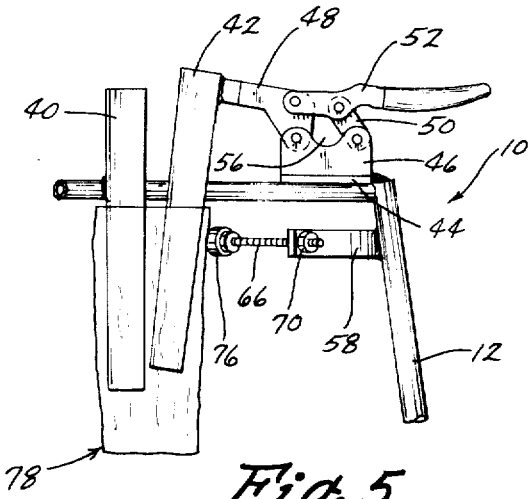
FIG. 5 is an elevated exploded view with parts broken away, showing in detail the sleeving stand throat expander in its non-expanded position.
Figure 6:
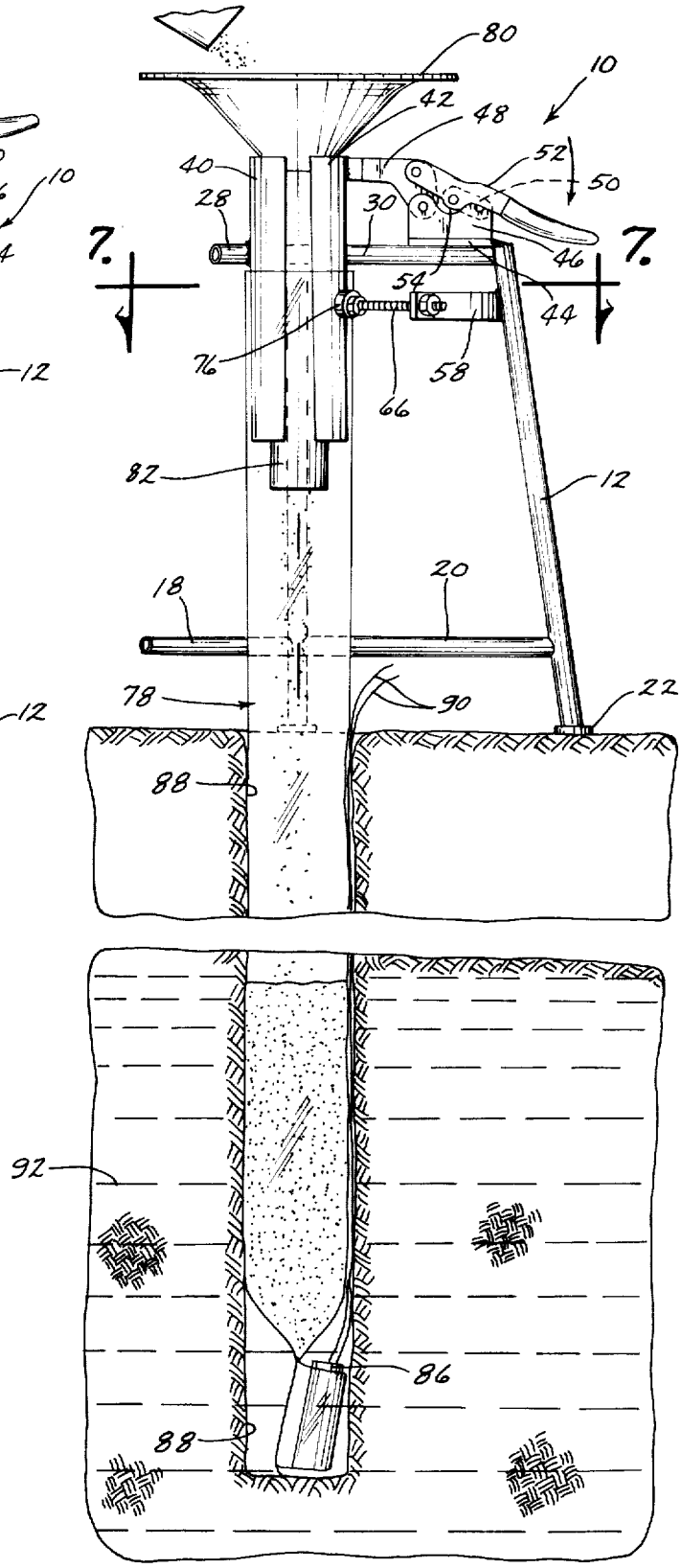
FIG. 6 shows the throat expander in its expanded position with the blasting sleeve secured thereto and with the loading funnel mounted within the expander as used during the loading of the bulk explosive powder.

Movable sleeve 42 is movable from a non-expanded position as shown in FIG. 5 to an expanded position as shown in FIG. 6 by operation of an over center locking clamp which is attached to the upper portion of movable sleeve 42.

The over center locking clamp is comprised of clamp mounting plate 44 which is welded to brace 30 with upstanding lock plate 46. Pivotally mounted to lock plate 46 are clamp linkage members 48 and 50. Linking member 48 is welded at one end to the movable arcuate sleeve 42 and at the opposite end pivotally connected to locking lever 52. Linkage member 50 in addition to being pivotally linked to upstanding plate 46 is pivotally linked at its opposite end to locking clamp lever 52. The arcuate edge of link 50 closest to its pivoted mounting to lever 52, designated here as 54, can be matingly received in cutout portion 56 of lock plate 46. In FIG. 5 the over center lock clamp is shown with the lock lever 54 in its upper non-locked position and with the movable sleeve 42 in its non-expanded position. In this position the loading tube sleeve as will hereinafter be more fully described in detail, can be conveniently placed over the throat expander which is comprised of the non-movable sleeve 40 and the movable sleeve 42. Pushing downward on locking lever 52 moves the top of the movable sleeve portion of the throat expander inwardly and downwardly and the bottom of movable sleeve member 42 outwardly and downwardly. Edge 54 is moved into engagement with cutout 56 with the throat moving to its expanded and locked position as shown in FIG. 7.

Mounted on leg 12 under plate 44 is U-shaped gripper bracket 58. U-shaped bracket 58 has its ends 60 and 62 bent outwardly and away from each other with an apeature, not depicted, therein. Threaded bolts 64 and 66 can be placed through the apertures in ends 60 and 62 and secured thereto by nuts 68 and 70 in conventional fashion. The heads of bolts 64 and 66 have adhesively bonded thereto rubber grippers 74 and 76.

Figure 7:
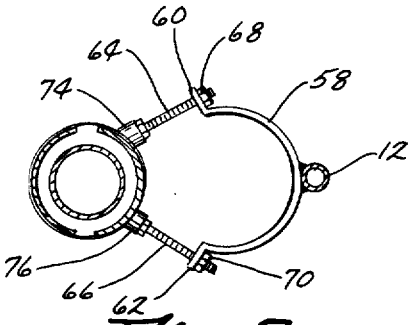
FIG. 7 is a sectional view of the gripping means along lines 7—7 of FIG. 6.

When the movable sleeve 42 is moved to its expanded position as shown in FIG. 7 by moving locking lever 52 to its downward position, grippers 74 and 76 engage the blasing hole liner 78 and hold it in secured relationship against movable sleeve 42.

As depicted in FIG. 1 a funnel of conventional construction is comprised of an inverted cone shaped portion 80 and a cylindrical funnel stem 82. The funnel stem 82 is of a proper diameter for convenient receipt in the throat expander comprised of the non-movable sleeve 40 and the movable sleeve 42.

Figure 4:
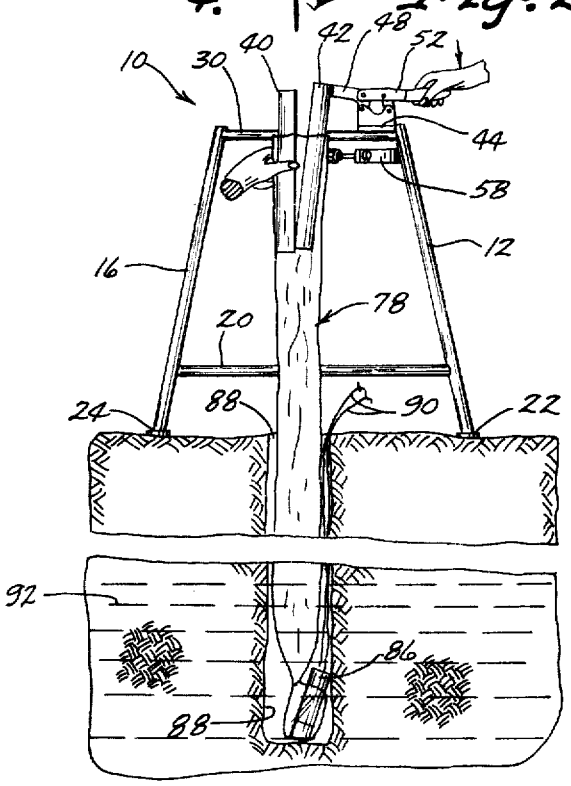
FIG. 4 is a view along line 4—4 of FIG. 2 showing how the blast hole liner is secured to the liner stand and being readied for filling with bulk explosive powder.

In operation, the sleeving stand assembly is used as follows:

A roll of blasting hole liner 78 is positioned on spindlle 38. A primer is placed in pocket 84 in order to provide weight to the liner 78. The liner 78 with the primer 86 in pocket 84 is then fed as depicted in FIG. 4 into the blast hole 88. After the liner is completely fed to the bottom of the blast hole 88, cutting edge 34 is used to cut the liner to the desired length. The cut liner is thereafter placed over the throat expander comprised of non-movable sleeve 40 and movable sleeve 42 as depicted in FIG. 5. The operator places his foot on footstand 26 in order to securely hold the stand in aligned realtionship with the blast hole. Locking lever 54 is moved in downward fashion to expand the throat expander by moving the movable sleeve 42 from the position of FIG. 5 to the position of FIG. 6. Grippers 74 and 76 engage the liner 78 and hold it in secured realtionship against the movable sleeve 42 as depicted in FIG. 7. The funnel is placed within the throat expander comprising the non-movable sleeve 40 and the movable sleeve 40 and loose bulk explosive such as ANFO is poured through the funnel through the throat expander and into the liner falling into the bottom thereof. The primer and the explosive are detonated by an electical inpulse received by wires 90 and are moved to the primer which explodes and in turn explodes the bulk ANFO charge. Water 92 is prevented from entering into mixture with the explosive charge by the liner.

Of course, prior to explosion of the blast hole charge, locking lever 54 is moved to its upward position and the liner disengaged from the throat expander and the entire stand assembly is moved away to a safe and secure position.

Figure 8:
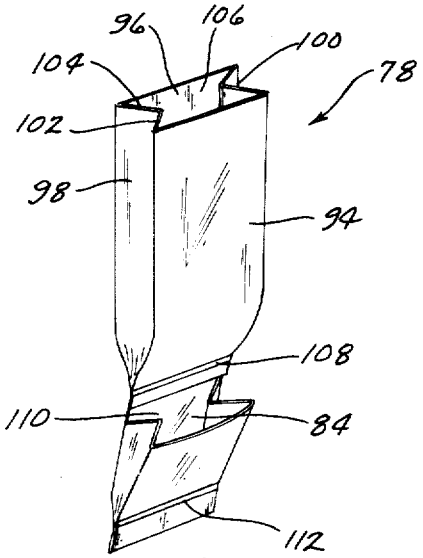
FIG. 8 is a perspective view of the preferred blast hole liner construction of this invention.

As previously mentioned and as depicted in FIG. 8, the invention also relates to a preferred blast hole liner. The blast hole liner of FIG. 8 generally depicted as numeral 78, is comprised of a heat sealable waterproof plastic material. In particular, it is comprised of a front wall panel 94 and a rear wall panel 96. Front wall panel 94 and rear wall panel 96 are joined by oppositely disposed gusset walls 98 and 100. Each of gusset walls 98 and 100 comprised of a front gusset wall portion 102 and a rear gusset wall partition 104. Gusset walls 98 and 100 allow for expansion of the blast hole liner.

Below the top opening 106 and transverse to the longitudinal axis of the liner 78 is a heat seal 108 which extends across each of front wall panel 94 and rear wall panel 96 and gusset walls 98 and 100.

Positioned below heat seal 108 is opening 110 defined by a portion of the front wall panel 94, and portions of the gusset wall panels 98 and 100. At the bottom of the liner 78 below heat seal 108 and below opening 110 is a second transverse heat seal 112 extending completely across the entire blast hole liner comprised of the front wall panel, the gusset walls, and the rear wall panel.

Positioned within the pocket 84 is a primer 86 or a like heavy object which allows for gravity feeding of the blast hole liner into the hole The gusseted configuration of the blast hole liner is advantageous in that air pockets are avoided since bulk explosive will freely fall through the liner and if it engages all sides of the liner, the gussets will merely expand to allow free movement therebetween without restriction. Thus air pockets are avoided. In addition, the liner is free from longitudinal seals and seams which avoid the possibility of such seams snagging on the walls of the blast hole. In addition, a blast hole liner having gusseted side walls as described herein does not have a tendency to adhere to the wet side walls of the blast hole as does a blast hole liner having flat side seams along its longitudinal axis.

Another advantage of the blast hole liner of this invention is that it can be conveniently and quickly made. A length of heat sealable waterproof plastic tubing having a front wall 94, a rear wall 96, and oppositely disposed gusset walls 98 and 100 is obtained. Heat seal 108 is formed transverse to the longitudinal axis of the liner and immediately below the heat seal a cut is formed across the front panel 94 and each of the gusset walls 98 and 100. Below the opening 110 defined by the cut previously described, a second transverse heat seal 112 is formed to form the bottom of the blast hole liner.

In addition to the advantages previously described, several other advantages of the blast hole liner having gusseted wall portions or pleats as decribed herein are readily apparent:

This allows a lay flat width equal to or less than the hole diameter;

The accordion pleat allows additional paths to bleed the air during the loading cycle which prevents a slug of air from being trapped and allows reliable fast loading;

The six pleats provide rigidity to keep the plastic sleeve from twisting while it is being lowered to the bottom of the blast hole;

The accordion design allows a lay flat width small enough that the sleeve does not adhere to the wet blast hole walls while it is being loaded;

The accordion design allows a lay flat width small enough to prevent the sleeve from catching the sharp rocks on the walls and puncturing the sleeve while it is being lowered into the blast hole.

The pleated design opens up easily when ANFO is loaded into the hole and the walls of the liner do not adhere to one another;

The pleated design expands on both sides so it opens up easier druing the loading cycle;

Since the pleated design does not rub the walls as much during lowering, a thinner plastic material, 0.004 mil., can be used without fear of snagging and this allows a more economical sleeve.

What is claimed is:

1. A blast hole liner sleeve having a top opening, and a bottom, comprising:

a heat sealable front wall panel, a heat sealable rear wall panel, said front and rear wall panels being joined by a pair of oppositely disposed gusset walls, a first heat seal transverse to the longitudinal axis of said sleeve and spaced upwardly from the bottom of said sleeve, an opening below said first heat seal defined by said front wall panel and said gusset walls, and a bottom heat seal spaced apart from and below said first heat seal and said opening.

2. A method of forming a blast hole liner comprising, obtaining a predetermined length of heat sealable sleeving having an open top end and an open bottom end, a front wall panel, a rear wall panel and a pair of oppositely disposed gusset walls forming a firt heat seal between said top end and said bottom end across each of said panels and gusset walls transverse to the longitudinal axis of said sleeve, cutting said front panel and gusset walls below said first heat seal, to define an opening, and forming a second heat seal across each of said panels and gusset walls, below said first heat seal and said opening.

* * * * *